US007311680B2

(12) United States Patent
Lenhart et al.

(10) Patent No.: US 7,311,680 B2
(45) Date of Patent: Dec. 25, 2007

(54) OPTIMAL CONTROL OF CPR PROCEDURE USING HEMODYNAMIC CIRCULATION MODEL

(75) Inventors: Suzanne M. Lenhart, Knoxville, TN (US); Vladimir A. Protopopescu, Knoxville, TN (US); Eunok Jung, Seoul (KR)

(73) Assignee: UT-Battelle, LLC, Oak Ridge, TN (US)

( * ) Notice: Subject to any disclaimer, the term of this patent is extended or adjusted under 35 U.S.C. 154(b) by 394 days.

(21) Appl. No.: 10/953,217

(22) Filed: Sep. 29, 2004

(65) Prior Publication Data

US 2006/0084892 A1 Apr. 20, 2006

(51) Int. Cl.
*A61H 31/00* (2006.01)

(52) U.S. Cl. ..... 601/41; 601/44

(58) Field of Classification Search ..... None
See application file for complete search history.

(56) References Cited

U.S. PATENT DOCUMENTS 5,876,347 A * 3/1999 Chesney et al. ..... 600/485
2003/0009119 A1* 1/2003 Kamm et al. ..... 601/149
2004/0153128 A1* 8/2004 Suresh et al. ..... 607/14
2004/0176679 A1* 9/2004 Murphy et al. ..... 600/407

OTHER PUBLICATIONS

C.F. Babbs, "CPR Techniques that Combine Chest and Abdominal Compression and Decompression: Hemodynamic Insights from a Spreadsheet Model," Circulation 1999, pp. 2146-2152.
Jung et al., "Cardiopulmonary Resuscitation Using Optimal Control," Proposal to the Seed Money Fund, posted on Internet May 2002.

* cited by examiner

*Primary Examiner*—Danton DeMille
(74) *Attorney, Agent, or Firm*—Akerman Senterfitt

(57) ABSTRACT

A method for determining a chest pressure profile for cardiopulmonary resuscitation (CPR) includes the steps of representing a hemodynamic circulation model based on a plurality of difference equations for a patient, applying an optimal control (OC) algorithm to the circulation model, and determining a chest pressure profile. The chest pressure profile defines a timing pattern of externally applied pressure to a chest of the patient to maximize blood flow through the patient. A CPR device includes a chest compressor, a controller communicably connected to the chest compressor, and a computer communicably connected to the controller. The computer determines the chest pressure profile by applying an OC algorithm to a hemodynamic circulation model based on the plurality of difference equations.

7 Claims, 3 Drawing Sheets

OPTIMAL CONTROL OF CPR PROCEDURE USING HEMODYNAMIC CIRCULATION MODEL

STATEMENT REGARDING FEDERALLY SPONSORED RESEARCH OR DEVELOPMENT

The United States Government has rights in this invention pursuant to Contract No. DE-AC05-00OR22725 between the United States Department of Energy and UT-Battelle, LLC.

CROSS-REFERENCE TO RELATED APPLICATIONS

Not applicable.

FIELD OF THE INVENTION

The invention relates to cardiopulmonary resuscitation (CPR), and more particularly to methods for determining a chest pressure profile based on an optimal control (OC) algorithm to maximize blood flow in a patient suffering cardiac arrest, and CPR devices for implementing the method.

BACKGROUND

The heart and lungs work together to circulate oxygenated blood. However, the heart can stop due to heart attack, electrical shock, drowning, or suffocation. Consequently, oxygenated blood may not flow to vital organs, particularly the brain. Brain cells begin to suffer and die within several minutes after the heart stops circulating blood. In the event of heart pumping failure, Cardio Pulmonary Resuscitation (CPR) is often administered to temporarily sustain blood circulation to the brain and other organs during efforts to restart the heart pumping. This effort is directed toward reducing hypoxic damage to the victim.

Generally, CPR is administered by a series of chest compressions to simulate systole and relaxations to simulate diastole, thus providing artificial circulatory support. Ventilation of the lungs is usually provided by mouth-to-mouth breathing or using an externally activated ventilator. Successful resuscitation is determined primarily by the time delay in starting the treatment, the effectiveness of the provider's technique, and prior or inherent damage to the heart and vital organs.

Manual CPR as taught in training courses worldwide can be easily started without delay in most cases. When properly administered, basic CPR can provide some limited circulatory support.

Despite the widespread use of CPR, and the use of certain mechanical devices, the survival of patients reviving from cardiac arrest remains poor. Each year, more than 250,000 people die in the U.S. from cardiac arrest. The rate of survival for CPR performed out of the hospital is estimated to be about 3%; and for patients who have cardiac arrest in the hospital, the rate of survival is only about 10-15%. The practical technique of CPR has changed little since the 1960's.

Most existing computer simulations of CPR use an electrical lumped parameter model of the circulation, governed by a system of ordinary differential equations (ODEs). Various mathematical models describe the standard CPR technique and various alternative CPR techniques such as: (i) interposed abdominal compression (IAC), (ii) active compression-decompression, and (iii) Lifestick CPR. Since all these models use fixed compression rates, the resulting blood flow will generally be significantly lower than its maximum possible value.

SUMMARY OF THE INVENTION

A method for determining a chest pressure profile for cardiopulmonary resuscitation (CPR) includes the steps of representing a hemodynamic circulation model based on a plurality of difference equations for a patient, applying an optimal control (OC) algorithm to the circulation model, and determining a chest pressure profile. The chest pressure profile defines a timing pattern of externally applied pressure to a chest of a patient to maximize blood flow through the patient.

Optimal control (OC) techniques have been used for some physical or engineering models. However, the inventors are the first to apply OC techniques to a CPR model.

OC can be based on differential or difference equations. The inventors first considered OC based system for determining the chest pressure profile based on a differential equations. In contrast, the current invention is a difference equation-based OC system for determining the chest pressure profile.

In a preferred embodiment, the circulation model can be an electrical model which represents the heart and blood vessels as RC networks, pressure in the chest and vascular components as voltages, blood flow as electric current, and cardiac and venous valves as diodes. The plurality of difference equations can comprise seven ordinary difference equations.

The OC algorithm can utilize both current and immediate past time steps as inputs to determine the applied pressure at a next time. In a preferred embodiment, the OC preferably maximizes blood flow as measured by pressure differences between the thoracic aorta and the right heart and superior vena cava of the patient. The method can further comprise the step of customizing the circulation model based on age, sex, and/or weight of the patient.

A CPR device includes a chest compressor for applying pressure to a chest of a patient, a controller communicably connected to the chest compressor, and a computer communicably connected to the controller. The computer determines a chest pressure profile, the profile defining a timing pattern of externally pressure applied by the chest compressor to a chest of the patient to maximize blood flow. The profile is determined by applying an optimal control (OC) algorithm to a hemodynamic circulation model based on a plurality of difference equations. The model is preferably an electrical model which represents the heart and blood vessels as RC networks, pressure in the chest and vascular components as voltages, blood flow as electric current, and cardiac and venous valves as diodes. The plurality of difference equations can comprise seven ordinary difference equations.

BRIEF DESCRIPTION OF THE DRAWINGS

There are shown in the drawing embodiments which are presently preferred, it being understood, however, that the invention can be embodied in other forms without departing from the spirit or essential attributes thereof.

DETAILED DESCRIPTION

A method for determining a chest pressure profile for cardiopulmonary resuscitation (CPR) includes the steps of representing a hemodynamic circulation model based on a plurality of difference equations for a patient, applying an optimal control (OC) algorithm to the circulation model, and determining a chest pressure profile. The chest pressure profile defines a timing pattern of externally pressure to be applied to the chest of the patient to maximize blood flow through the patient. The resulting chest pressure profile provides a time dependent (variable compression rate) pressure profile to be followed in the CPR process. Based on the invention, an increase of 20% or more in blood flow is estimated to generally result as compared to conventional fixed-compression rate (time-independent) CPR strategies. This significant increase in blood flow provided by the invention may represent the difference between life and death for a significant number of people who undergo cardiac arrest.

Although a variety of hemodynamic models can be used with the invention, the hemodynamic circulation model preferably used is a multicompartment lumped parameter model. This preferred model represents heart and blood vessels as resistive-capacitive (RC) networks, pressure in the chest and vascular components as voltages, blood flow as electric current, and cardiac and venous valves are diodes, such as disclosed by Babbs (C. F. Babbs, "CPR Techniques that Combine Chest and Abdominal Compression and Decompression: Hemodynamic Insights from a Spreadsheet Model", Circulation 1999, 2146-2152; hereinafter "the Babbs' model"). The advantage of the Babbs' model is that it provides low dimensionality and good comparison with real data.

Figure 1:
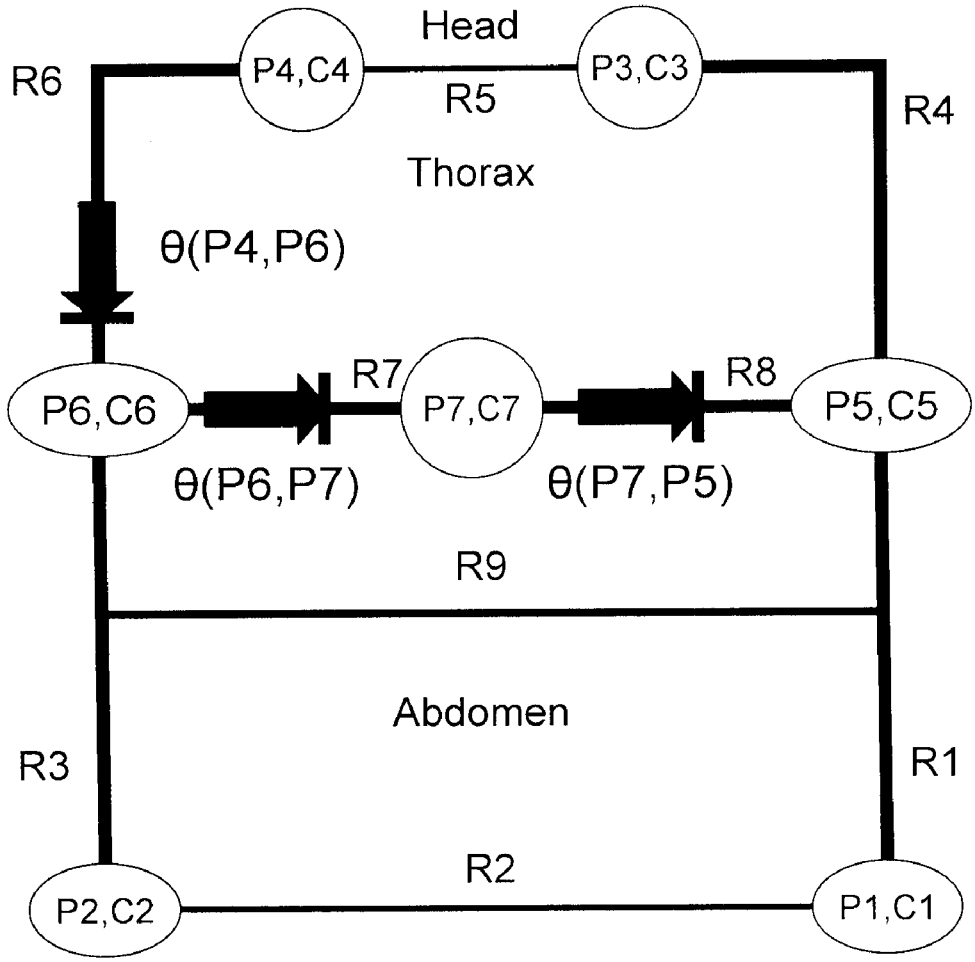
Figure 1 (Prior Art)
FIG. 1 shows the elements of the Babbs' lumped parameter electrical model.

The Babbs' model is a lumped parameter model for the circulatory system, wherein the heart and blood vessels in various parts of the body are represented as resistance-capacitive networks, similar to electric circuits. Following the analogy with Ohm's law, pressures in the chest, abdomen, and vascular compartments are interpreted as voltages, blood flow as an electric current, and cardiac and venous valves as diodes—electrical devices that permit current flow in only one direction. The analog of the capacitance is the compliance C, defined as $C=\Delta V/\Delta P$, where $\Delta P$ is the incremental change in pressure within a compartment as volume $\Delta V$ is introduced. FIG. 1 shows the elements of the Babbs' lumped parameter electrical model. Three major sections consisting of the head, the thorax and the abdomen are included. Table 1 below shows the corresponding model parameters.

TABLE 1

| Pressures, Compliances | | Resistances | |
|---|---|---|---|
| Abdominal aorta | $P_1$, $c_{aa}$ | Aorta | $R_a$ |
| Inferior vena cava | $P_2$, $c_{ivc}$ | Subphrenic organs | $R_s$ |
| Carotid artery | $P_3$, $c_{car}$ | Subphrenic vena cava | $R_v$ |
| Jugular veins | $P_4$, $c_{jug}$ | Carotid arteries | $R_c$ |
| Thoracic aorta | $P_5$, $c_{ao}$ | Head + arm resistance | $R_h$ |
| Right heart & Superior vena cava | $P_6$, $c_{rh}$ | Jugular veins | $R_j$ |
| Chest pump | $P_7$, $c_p$ | Pump input (tricuspid valve) | $R_i$ |
| | | Pump output (aortic valve) | $R_o$ |
| | | Coronary vessels | $R_{ht}$ |

As noted above, the inventors first considered OC based on a differential equation approach. Extending Babbs' difference model, a system of seven (7) ordinary differential equations were derived upon which the temporal variation of pressure was calculated for each compartment.

In contrast, in the state system according to the present invention, the temporal variation of the applied pressure is calculated for each compartment from a system of difference equations. These equations are derived from the fundamental properties of the circulatory system, including the relationship between pressure gradient and blood flow, and the definition of compliance noted above. In a preferred embodiment, the CPR model includes seven difference equations, with time as the underlying variable which describes the hemodynamics. Thus, there is one difference equation for the time evolution of each pressure variable. The pattern of external pressure on the chest acting as the "control" is preferably the non-homogeneous forcing term in this system. Other external pressure controls such as the abdominal pressure can be considered in a similar fashion. In a preferred embodiment, the OC seeks to maximize the blood flow as measured by the pressure differences between the thoracic aorta and the right heart and superior vena cava.

Referring again to FIG. 1 and to Table 1, the seven (7) pressure state variables are as follows:

$P_1$ pressure in abdominal aorta
$P_2$ pressure in inferior aorta
$P_3$ pressure in carotid
$P_4$ pressure in jugular
$P_5$ pressure in thoracic aorta
$P_6$ pressure in right heart and superior vena cava
$P_7$ pressure in thoracic pump At the step n, when time is $n\Delta t$, the pressure vector is denoted by $$P(n)=(P_1(n),P_2(n), \ldots ,P_7(n)).$$

It is assumed that the initial pressure values in each of the seven compartments are known, $P(0)=(P_1(0), P_2(0), P_3(0), P_4(0), P_5(0), P_6(0), P_7(0))$. To render the chest pressure profiles medically reasonable, it is further assumed that the admission controls are equal at the beginning and the end of the time interval, $u(0)=u(N-1)$. Using a control vector $u=(u(0), u(1), u(2), u(N-2), u(0))$, the difference equations (in vector notation) representing the circulation model are as follows:

$$P(1)=P(0)+T(u(0))+\Delta tF(P(0)) \tag{1.1}$$

$$P(n+1)=P(n)+T(u(n)-u(n-1))+\Delta tF(P(n)),\ n=1,2, \ldots , N-1 \tag{1.2}$$

where T represents the linear map, $$T(u(n))=(0,0,0,0,\ t_p u(n), t_p u(n),\ u(n)).$$

Here the factor $t_p$ depends on the strength of the chest pressure.

It is noted that that the pressure vector depends on the control, P=P(u), and the calculation of the pressures at the next time step (n+1) requires both the values of the controls at the current step (n) and previous step (n−1). In contrast, in conventional difference equation-based OC systems, the control from only the previous step enters into the states of the next step. See "Optimal control theory: Applications to management science and economics" by S. Sethi and G. L. Thompson, Kluwer Academic, 2000 for a review of conventional difference equation-based OC theory.

The function F(P(n)) can be defined by listing its seven components:

$$\frac{1}{c_{aa}}\left[\frac{1}{R_a}(P_5(n)-P_1(n))-\frac{1}{R_s}(P_1(n)-P_2(n))\right]$$

$$\frac{1}{c_{ivc}}\left[\frac{1}{R_s}(P_1(n)-P_2(n))-\frac{1}{R_v}(P_2(n)-P_6(n)\right]$$

$$\frac{1}{c_{car}}\left[\frac{1}{R_c}(P_5(n)-P_3(n))-\frac{1}{R_h}(P_3(n)-P_4(n))\right]$$

$$\frac{1}{c_{jug}}\left[\frac{1}{R_h}(P_3(n)-P_4(n))-\frac{1}{R_j}V(P_4(n)-P_6(n))\right]$$

$$\frac{1}{c_{ao}}\left[\frac{1}{R_o}V(P_7(n)-P_5(n))-\frac{1}{R_c}(P_5(n)-P_3(n))\right]\frac{1}{R_a}(P_5(n)-P_1(n))-\frac{1}{R_{ht}}V(P_5(n)-P_6(n))\Big]$$

$$\frac{1}{c_{rh}}\left[\frac{1}{R_j}V(P_4(n)-P_6(n))-\frac{1}{R_v}(P_2(n)-P_6(n))+\frac{1}{R_{ht}}(P_5(n)-P_6(n))-\frac{1}{R_i}V(P_6(n)-P_7(n))\right]$$

$$\frac{1}{c_p}\left[\frac{1}{R_i}V(P_6(n)-P_7(n))-\frac{1}{R_o}V(P_7(n)-P_5(n))\right]$$

where the valve function is defined by:

$$V(s)=s \text{ if } s\geqq 0$$

$$V(s)=0 \text{ if } s\leqq 0.$$

It is noted that F is a linear function except for the valve function. To be rigorous mathematically, the valve function can be approximated by a smooth function that is differentiable at zero.

Assuming $-K\leqq u(n)\leqq K$ for all n=0,1, . . . , N−2 and choosing the control set $$U=\{(u(0),u(1),\ldots,u(N-2),u(0))|-K\leqq u(n)\leqq K, n=0,1,\ldots,N-2\}.$$

an objective function is defined:

$$J(u)=\sum_{n=1}^{N}[P_5(n)-P_6(n)]-\sum_{n=0}^{N-2}\frac{B}{2}u^2(n) \tag{1.3}$$

The first term represents the pressure differences between the thoracic aorta and the right head superior vena cava and is referred to as the systemic perfusion pressure. The second term represents the cost of implementing the control and has the double effect of stabilizing the control problem and yielding an explicit characterization for the optimal control. The goal is to maximize bloodflow J(u), i.e., to find an u* such that:

$$J(u^*)=\max_u J(u).$$

Controls entering the system at two time levels (current and immediate past time steps) to give input to the pressure at the next time can be based on an adaptation of the discrete version of Pontryagin's Maximum Principle. The characterization of the optimal control in terms of the solutions of the optimality system, which is the pressure system and an adjoint system, is given below.

The existence of an optimal control u* in U that maximizes the objective functional J is standard, since compactness is ensured, due to the finite number of state variables with continuous functions in the equations and the finite number of time steps. To characterize an optimal control, the map must be differentiated u→J(u), which requires the differentiation of the solution map u→P=P(u). [see M. I. Kamien and N. L. Schwarz, *Dynamic Optimization*, North-Holland, Amsterdam 1991.; J.-L. Lions, *Optimal Control of Systems Governed by Partial Differential Equations*, Springer-Verlag, New York, 1971]

Theorem 1.

The mapping u∈U→P is differentiable in the following sense:

$$\frac{P(u+\varepsilon l)(n)-P(u)(n)}{\varepsilon}\P\psi(n)$$

as ε→0 for any u∈U and l such that (u+εl)∈U for ε small, for n=1, . . . , N. Also ψ satisfies the discrete system:

$$\psi(n+1)=\psi(n)+\Delta t M(n)\psi(n)+T(l(n)-l(n-1)) \tag{2.1}$$

$$\psi(N)=\psi(N-1)+\Delta t M(N-1)\psi(N-1)+T(l(0)-l(N-2)) \tag{2.2}$$

$$\psi(0)=0 \tag{2.3}$$

$$\psi(1)=T(l(0)) \tag{2.4}$$

for n=1, . . . , N−2, where $$M(n)=\frac{\partial F(P(n))}{\partial P}.$$

Proof: This follows from the component-wise calculation of the difference quotient and passage to the limit in each component, using the differentiability of the function F. It is noted that in order to compute the derivative rigorously, differentiable approximation to the valve function should be used.

Note: To illustrate the elements in the matrix M, the first row is written below:

$$-\frac{1}{c_{aa}}\left(\frac{1}{R_a}+\frac{1}{R_s}\right),\ \frac{1}{c_{aa}R_s},\ 0,\ 0,\ \frac{1}{c_{aa}},\ 0,\ 0$$

and a row with a valve term, like the fourth row:

$$0,\ 0,\ \frac{1}{c_{jug}R_h},\ \frac{1}{c_{jug}}\left(\frac{1}{R_h}+\frac{1}{R_j}V'(P_4-P_6)\right),\ 0,\ -\frac{1}{c_{jug}R_j}V'(P_4-P_6)$$

Theorem 2.

Given an optimal control u* and the corresponding state solution, P*=P(u*), there exists a solution satisfying the adjoint system:

$$\lambda(n-1)=\lambda(n)+\Delta t M^{\tau}(n-1)\lambda(n)+(0,0,0,0,1,-1,0) \tag{2.5}$$

$$\lambda(N)=(0,0,0,0,1,-1,0), \tag{2.6}$$

where n=N, . . .2. Furthermore, for n=1,2, . . . , N−2, $$u^*(n)=\frac{1}{B}(t_p(\lambda_5(n+1)+\lambda_6(n+1))-\lambda_5(n+2)-\lambda_6(n+2))+\lambda_7(n+1)-\lambda_7(n+2)) \tag{2.7}$$

and for $n=0$, $$u^*(0)=\frac{1}{B}(t_p(\lambda_5(N)+\lambda_6(N)+\lambda_5(1)+\lambda_6(1)-\lambda_5(2)-\lambda_6(2))+\lambda_7(N)+\lambda_7(1)-\lambda_7(2)), \tag{2.8}$$

where the controls are subject to the prescribed bounds, $M^{\tau}$ is the transpose of the matrix M, which depends on the state P .

Proof: Let u* be an optimal control and P its corresponding state. Let $(u^*+\epsilon l)\in U$ for $\epsilon>0$, and $p^{\epsilon}$ be the corresponding solution of the state system. Since the adjoint system is linear, there exists a solution λ satisfying (2.5). The directional derivative of the functional J(u) is computed with respect to u in the direction l. Since J(u*) is the maximum value, the following inequality results:

$$\begin{aligned}
0 &\le \lim_{\varepsilon\to 0^+}\frac{J(u^*+\varepsilon l)-J(u^*)}{\varepsilon}\\
&=\sum_{n=1}^{N}[\psi_5(n)-\psi_6(n)]-\sum_{n=0}^{N-2}Bu^*(n)l(n)\\
&=\sum_{n=1}^{N-1}\psi(n)\cdot[\lambda(n)-\lambda(n+1)-\Delta t M^{\tau}(n)\lambda(n+1)]-\\
&\quad\sum_{n=0}^{N-2}Bu^*(n)l(n)+\psi(N)\cdot\lambda(N)\\
&=\sum_{n=1}^{N-2}\lambda(n+1)\cdot[\psi(n+1)-\psi(n)-\Delta t M(n)\psi(n)]-\\
&\quad\sum_{n=0}^{N-2}Bu^*(n)l(n)+\lambda(N)\cdot[\psi(N)-\psi(N-1)-\\
&\quad\Delta t M(N-1)\psi(N-1)]+\lambda(1)\cdot\psi(1)\\
&=\sum_{n=1}^{N-2}\lambda(n+1)\cdot T(l(n)-l(n-1))+\lambda(1)\cdot\psi(1)-\\
&\quad\sum_{n=0}^{N-2}Bu^*(n)l(n)+\lambda(N)\cdot T(l(0)-l(N-2))\\
&=\sum_{n=1}^{N-3}l(n)[(\lambda_7+t_p(\lambda_5+\lambda_6))(n+1)-\\
&\quad(\lambda_7+t_p(\lambda_5+\lambda_6))(n+2)-Bu^*(n)]+\\
&\quad l(N-2)[t_p(\lambda_5+\lambda_6)(N-1)+\lambda_7(N-1)-Bu^*(N-2)]+
\end{aligned}$$

-continued $$\lambda(1)\cdot\psi(1)+\lambda(N)\cdot T(l(0)-l(N-2))-l(0)[t_p((\lambda_5+\lambda_6)(2))+\lambda_7(2)-Bu^*(0)]$$

Using the equality ψ(1)=T(l(0)), terms with coefficients l(0) can be grouped together. Since l(0) is arbitrary within the constraint that u*(0)+ϵl(0) satisfies the control bounds, u*(0) can be solved for explicitly. From the summation above with n=1 to N−3, u*(n) can be solved for and then for u*(N−2). it is noted that the controls are subject to the control bounds. The representation (2.7)-(2.8) is obtained by choosing appropriate variations l.

Thus, the optimal control is completely and explicitly characterized in terms of the solution of the optimality system involving the optimal state and adjoint variables. The solution of the optimality system is preferably carried out iteratively. After an initial control guess, the iterative method can use forward sweeps of the state system followed by backward sweeps of the adjoint system with control updates between. See E. Jung, S. Lenhart, and Z. Feng, "Optimal Control of Treatments in a Two Strain Tuberculosis Model," Discrete and Continuous Dynamical Systems 2 (2002), 473-482 for similar iteration techniques. The numerical solution yields the optimal control and thereby improves performance over standard CPR techniques. The results obtained indicate that more rapid changes in the external pressure levels than those currently performed within standard CPR may yield up to 20% increase in the systemic perfusion pressure. For many people who undergo cardiac arrest, this may represent the difference between life and death.

More detailed circulation models, which include additional compartments and spatial dependence described by partial differential equations are expected to yield even better results when combined with the invention. Moreover, the circulation model equations can be customized, such as to account for various age, sex, and weight groups within the general population. Such customizing factors can be implemented using additional coefficients in the system.

Figure 2:
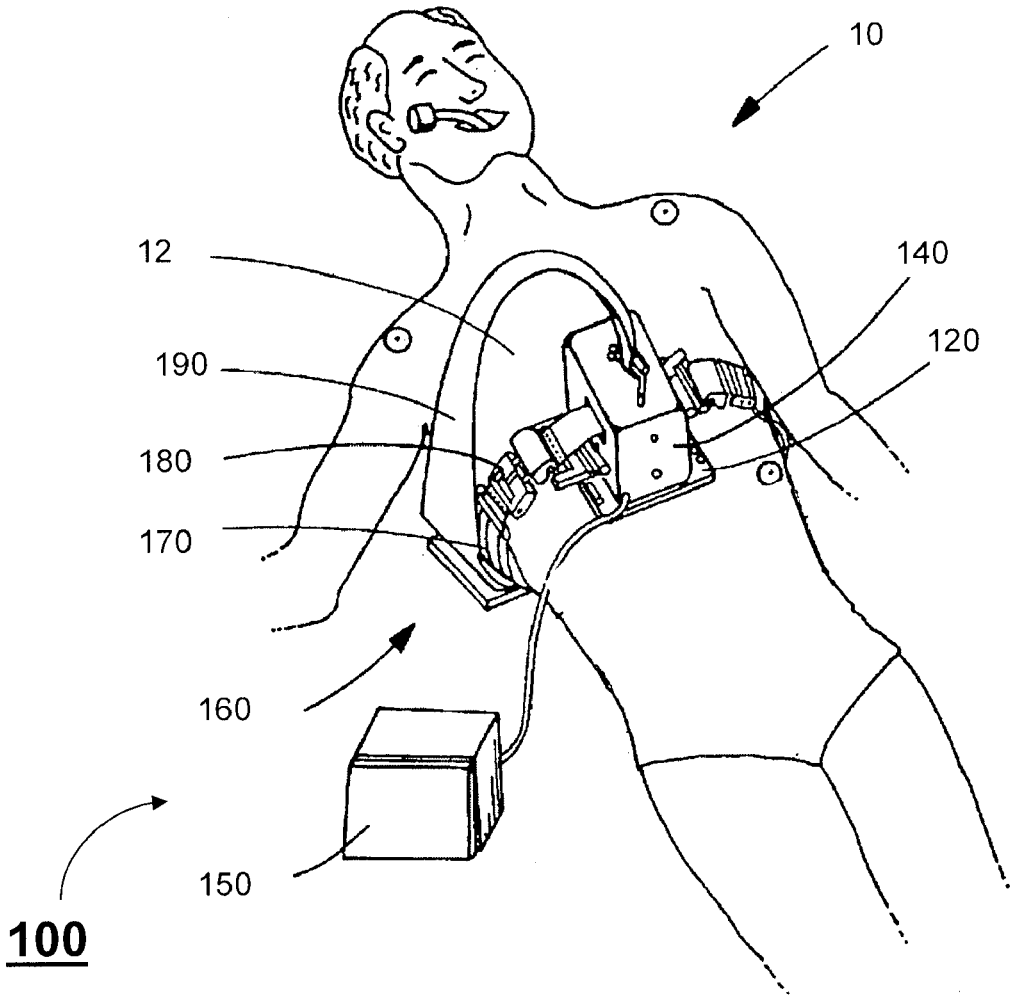
FIG. 2 shows an exemplary CPR system according to an embodiment of the invention.

The control strategy described herein can be easily programmed onto a small computer and imbedded into a portable device. Now referring to FIG. 2, the present invention is shown embodied as a CPR system 100 for use with a victim 10 in need of CPR. System 100 can be a portable system. System 100 generally comprises a chest-positioner/pad 120, compression device 140, control system 150, an assembly 160 for securing the compression device 140 to victim 10, strap 170, connector 180 and recoil spring 190 for exerting an upward recoil force to lift the compression device 140 and victim's anterior chest wall 12. A pressure sensor (not shown) is located in the base of the compression device 140.

Control system 150 includes a controller which is communicably connected to compression device 140. Control system 150 includes a computing device, such as a microprocessor communicably connected to the controller. The computing device determines the chest pressure profile which defines a timing pattern of externally pressure applied by compression device 140 to chest wall 12 of patient 10. The profile is determined by applying an optimal control algorithm to a hemodynamic circulation model based on a plurality of difference equations according to the invention as described above.

The invention can be applied to CPR other than standard CPR. The invention can also be configured as part of a control system. Although not shown in FIG. 2, system 100 can include an indirect blood flow measuring device. For example, indirect measures including carbon dioxide excretion, oxygen blood content by clip-on ear sensors, or pressure measurement at the hospital under monitored circumstances can be used as approximate measures of blood flow. Using this information, feedback can be included to update initial conditions and restart the OC cycle.

Figure 3:
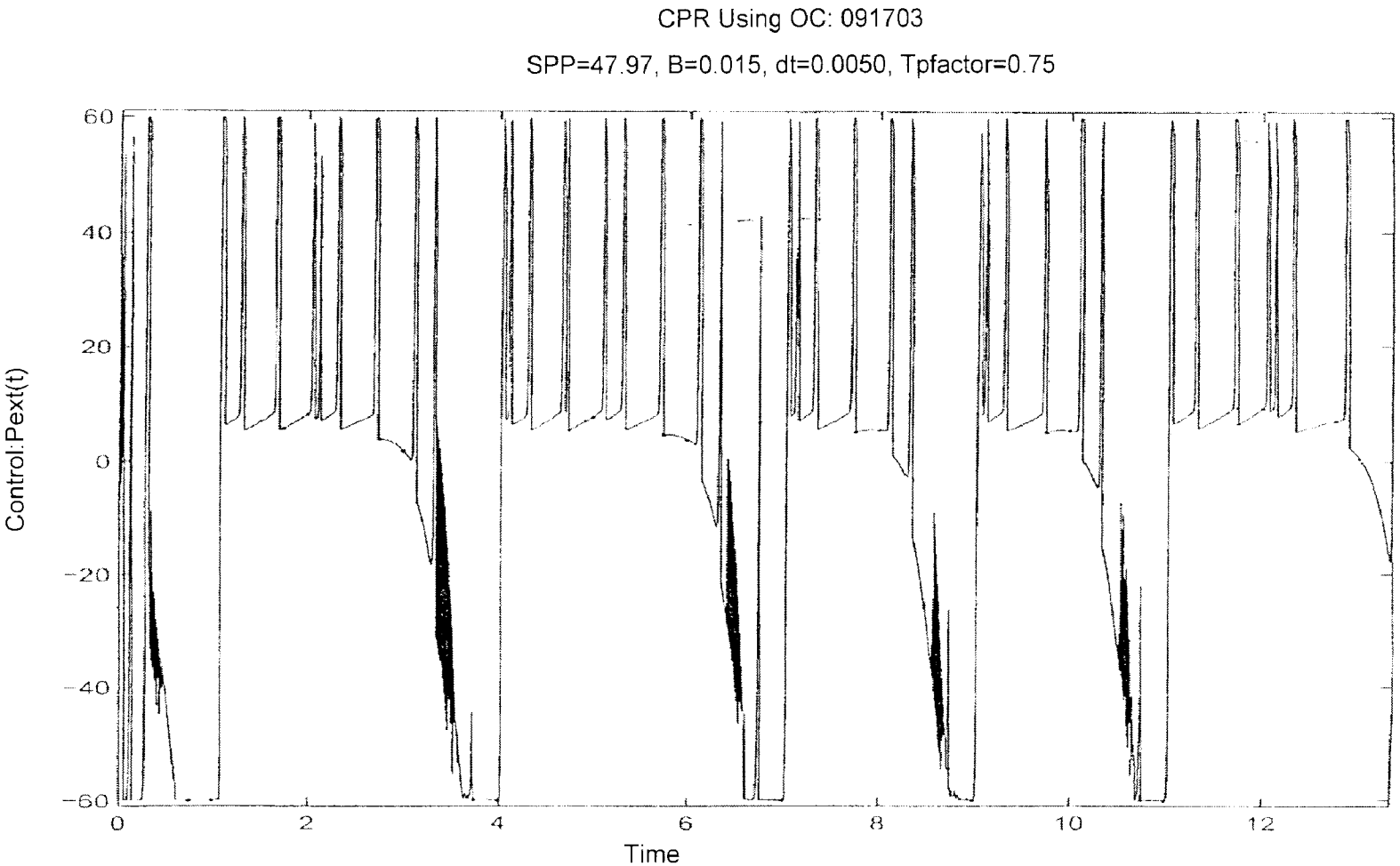
FIG. 3 shows an exemplary optimal chest profile derived using the invention.

The OC derived chest pressure profile according to the invention has been found to provide a significant improvement over the standard CPR procedure. The improvement can be measured in terms of system perfusion pressure (SPP), a measure of blood flow between the thoracic aorta and the right heart and superior vena cava. FIG. 3 shows an exemplary optimal chest profile derived using the invention. The time scale is in seconds. The term dt gives the size of the time step. The coefficient B is the stabilizing factor and Tp factor is the strength of the cardiac pump. The SPP obtained from this example is higher than the SPP from standard CPR technique as disclosed by Babbs, by about 20%.

The pressure fluctuation seen in this exemplary profile is typical of many of the examples run and indicates that rapid changes in pressure levels can make a significant improvement in SPP. This profile can be considered as type of CPR with active compression and decompression (ACD) of the chest. The SPP for this example compares favorably with the SPP calculated from the standard ACD procedure.

This invention can be embodied in other forms without departing from the spirit or essential attributes thereof and, accordingly, reference should be had to the following claims rather than the foregoing specification as indicating the scope of the invention.

We claim:

1. A method for determining a chest pressure profile for cardiopulmonary resuscitation (CPR), comprising the steps of:

providing a hemodynamic circulation model for a patient, said model based on a plurality of difference equations;

applying an optimal control (OC) algorithm to said circulation model and determining a chest pressure profile for said patient, said profile defining a timing pattern for externally applying pressure to a chest of said patient to maximize blood flow though said patient, wherein said OC algorithm utilizes an applied pressure from a current time step (n) and an applied pressure from an immediate past time step (n−1) as inputs for determining a pressure to apply at a next time step (n+1).

2. The method of claim 1, further comprising the step of customizing said model based on at least one selected from the group consisting of age, sex, and weight of said patient.

3. The method of claim 1, wherein said OC maximizes blood flow as measured by pressure differences between the thoracic aorta and the right heart and superior vena cava of said patient.

4. A CPR device, comprising:

a chest compressor for applying pressure to a chest of a patient, a controller communicably connected to said chest compressor, and a computer communicably connected to said controller, said computer determining a chest pressure profile, said profile defining a timing pattern of externally pressure applied by said chest compressor to a chest of said patient to maximize blood flow, said profile determined by applying an optimal control (OC) algorithm to a hemodynamic circulation model based on a plurality of difference equations, wherein said OC algorithm utilizes an applied pressure from a current time step (n) and an applied pressure from an immediate past time step (n−1) as inputs for determining a pressure to apply at a next time step (n+1).

5. The device of claim 4, wherein said model is an electrical model which represents the heart and blood vessels as RC networks, pressure in the chest and vascular components as voltages, blood flow as electric current, and cardiac and venous valves as diodes.

6. The device of claim 4, wherein said plurality of difference equations comprise seven ordinary difference equations.

7. The device of claim 4, wherein said OC maximizes blood flow as measured by pressure differences between the thoracic aorta and the right heart and superior vena cava of said patient.

* * * * *